US005323151A

United States Patent [19]

Parsadayan

[11] Patent Number: 5,323,151

[45] Date of Patent: Jun. 21, 1994

[54] QUICK CLOSE CIRCUIT FOR ELECTRIC GATE

[75] Inventor: Walodia M. Parsadayan, Laguna Niguel, Calif.

[73] Assignee: Dial Code, Inc., Orange, Calif.

[21] Appl. No.: 778,259

[22] Filed: Oct. 17, 1991

[51] Int. Cl.[5] ..... G08G 1/01

[52] U.S. Cl. ..... 340/933; 49/31

[58] Field of Search ..... 340/941, 933, 928, 825.31, 340/825.34; 49/31, 49; 404/6; 307/116; 361/179

[56] References Cited

U.S. PATENT DOCUMENTS

| | | | |
|---|---|---|---|
| 2,801,844 | 8/1957 | Cook | 49/25 |
| 3,368,305 | 2/1968 | Piekarski | 49/70 |
| 3,874,117 | 4/1975 | Boehm | 49/264 |
| 3,891,900 | 6/1975 | Gallant | 361/179 |
| 3,975,861 | 8/1976 | Baump et al. | 49/28 |
| 4,604,826 | 8/1986 | Sorber | 49/31 |
| 4,614,057 | 9/1986 | Sorber | 49/29 |
| 4,621,452 | 11/1986 | Deeg | 49/28 |

*Primary Examiner*—Hezron E. Williams
*Assistant Examiner*—Christine K. Oda
*Attorney, Agent, or Firm*—Poms, Smith, Lande & Rose

[57] ABSTRACT

A quick close circuit is provided for an electric powered gate having a wire loop control system comprising a gate control circuit, a wire loop in a passageway of the gate, and a loop detector circuit to sense presence of vehicles in the loop. The quick close circuit provides for the opening of the gate upon detection of a vehicle in the passageway by the loop detector circuit. After the vehicle has passed through the passageway, the quick close circuit stops further opening of the gate and commences the closing of the gate.

8 Claims, 3 Drawing Sheets

QUICK CLOSE CIRCUIT FOR ELECTRIC GATE

INTRODUCTION

Generally stated, the present invention relates to electric gates and security systems for homes and buildings, and more particularly to an electronic circuit to reduce the amount of time that the gate remains open after entry of an automobile.

BACKGROUND OF THE INVENTION

Many homes and buildings commonly use electric gates to protect their passageways, providing both convenience and security for the occupants. The typical electric gate blocks entrance to the structure, effectively preventing unwanted intruders from gaining access. When a proper user wants access, the gate control system is energized by the operator to temporarily open the gate.

The typical electric gate system uses a central control circuit to regulate operation of the gate. Electric gates are often controlled remotely, such as by a remote transmitter kept in a car, or alternatively can be opened by the use of a key switch. Once energized, the gate either slides out of the blocking position, or pivots upward, to a fully open position allowing cars or pedestrians to enter or exit the passageway. While the simpler systems use timing circuits which keep the gate open for a fixed period of time to allow the car to enter or exit, more sophisticated gate controllers often utilize circuitry linked to sensors which detect the presence of the moving cars. In each of these systems, the gate automatically closes once the sensor is tripped or the specified time elapsed.

A problem frequently experienced with such systems is that the gate remains in an open state too long. The typical gate is large in comparison to an automobile. It is common for entering cars to have entered past the gate long before the gate has reached the fully open position. The gate would then remain fully open for a brief period of time, then begin the closing process. While this period of time is slight, it could be enough to allow a second car or other pedestrian intruder to enter, thus compromising the security system.

Electric gate systems which close the gate immediately after a car has entered are known in the industry One such system is disclosed in U.S. Pat. No. 2,801,844, for "Automatic Door Control" issued to Cook. The Cook patent uses a photo-electric means comprising a light source and photo-electric relay to sense the passage of an automobile and command the closing of the gate. However, a drawback of the Cook door closing system is that photo-electric relays and light sources are very unreliable, due to the susceptibility of the photo-electric relay to obscuration by dirt or dust. For this reason, most modern electric gates use a wire loop sensing system, rather than a photo-electric system.

In a wire loop system, a wire is embedded in the driveway forming a large loop adjacent to the gate passageway. An electric current is conducted through the loop which acts as an inductor. When an automobile approaches the gate, the driver initiates the gate opening by use of either a key switch or an RF transmitter. As the vehicle passes over the driveway portion containing the loop, the metal and mass of the vehicle changes the inductance of the loop, altering the current output. The control circuit for the electric gate senses the change in current and keeps the gate open during this period of time. After the car has passed, and the current in the loop has returned to a normal level, the control circuit initiates the gate closing. Nevertheless, if the vehicle has entered the passageway before the gate has fully opened, the control system will still bring the gate to the fully open position before beginning the closing cycle. Therefore, even wire loop sensing systems have the same problem of the gate remaining open too long, allowing unwanted intruders to follow a vehicle through the passageway before the gate closes.

Therefore, it would be advantageous to provide a system for use within a wire loop sensing system which would close the electric gate immediately after a vehicle has passed the loop rather than delaying until the gate reaches the fully open position. Further, it would also be desirable to provide a system which could be easily added by modifying a pre-existing control circuit and wire loop sensing system, rather than by replacing the control circuit.

SUMMARY OF THE INVENTION

It is therefore a primary object of the present invention to provide a system for use within a wire loop sensing system which would close the electric gate immediately after a vehicle has passed the loop rather than delaying until the gate reaches the fully open position. A secondary object of the present invention is to provide a system which could be easily added by modifying a pre-existing control circuit and wire loop sensing system, rather than by replacing the control circuit.

Generally, the present invention is intended for use in an electric powered gate having a wire loop control system comprising a gate control circuit, a wire loop in the passageway of said gate, and a loop detector circuit to sense the presence of vehicles in the loop. The quick close circuit of the present invention comprises a means for detecting the passage of a vehicle through the passageway, and a means for commanding the gate control circuit to stop opening the gate and to commence closing the gate after the passage of the vehicle.

A more complete understanding of the quick close circuit for an electric gate of the present invention will be afforded to those skilled in the art, as well as a realization of additional advantages and objects thereof, by a consideration of the following detailed description of a preferred exemplary embodiment. Reference will be made to the appended sheets of drawings which will be first described briefly.

DETAILED DESCRIPTION OF A PREFERRED EXEMPLARY EMBODIMENT

Figure 1:
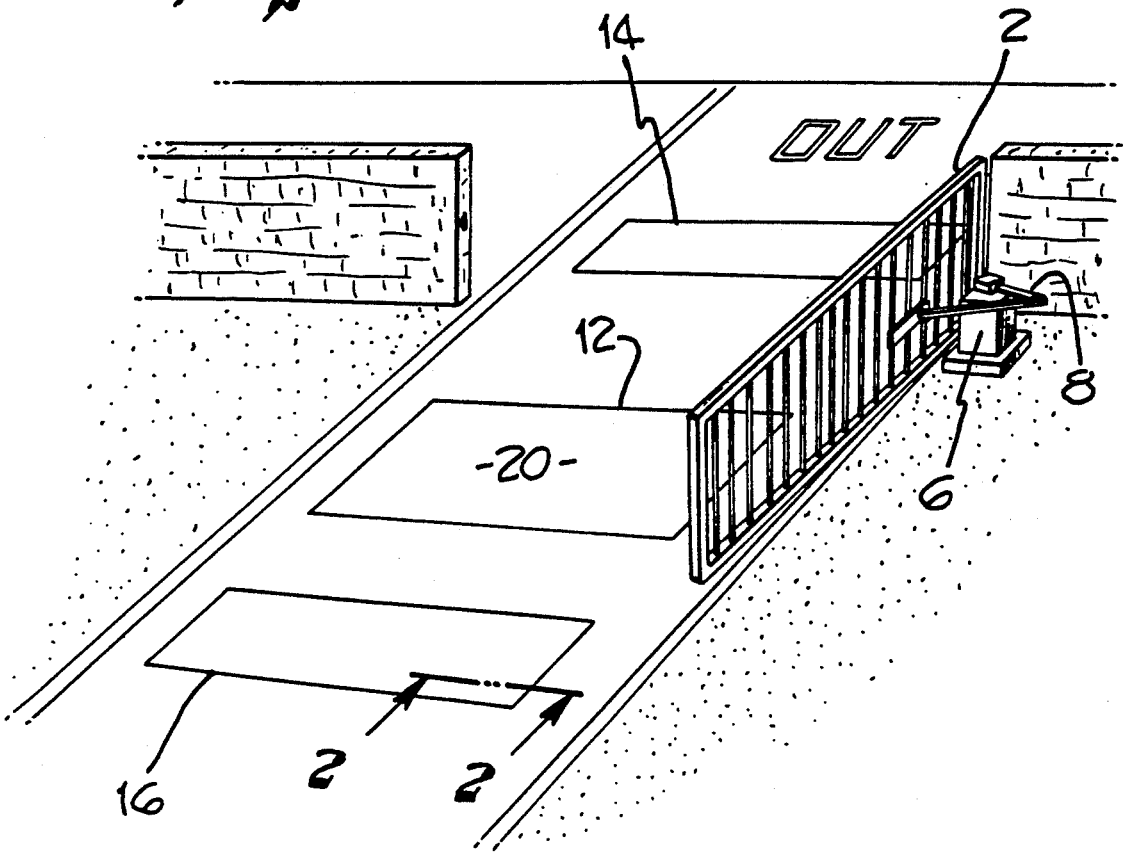
FIG. 1 shows an exemplary electric gate utilizing a ground wire loop sensing system.

Referring first to FIG. 1, there is shown an exemplary electric swinging gate. Gate 2 is attached by pivoting linkage 8 to the control mechanism within housing 6, and pivots out of the blocking position either to the left or to the right upon activation by the control mechanism. A conventional electric powered gate system uses a motor to manipulate the gate, and a gate controller circuit to control operation of the motor. Each of these components would ordinarily be contained within housing 6. The gate controller receives an input signal, either via an RF receiver, a key switch or other like input device, then controls the operation of the motor to manipulate gate 2 to an open position.

Figure 2:
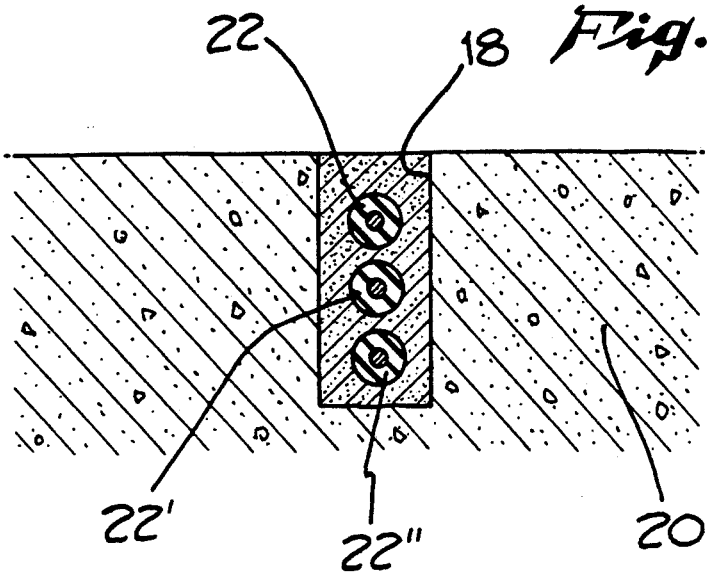
FIG. 2 shows an exemplary wire loop within a ground trench, as taken through the section 2—2 of FIG. 1.

The exemplary electric gate of FIG. 1 utilizes a wire loop sensing system to sense the presence of vehicles in the passageway of gate 2. In the exemplary wire loop sensing system, wire 22 is embedded in a trench 18 within the driveway 20 forming a large loop 12 adjacent to the gate passageway. An electric current is conducted through wire 22 which acts as an inductor. Typically, wire 22 traverses the loop numerous times, exemplarily shown as 22' and 22" in FIG. 2. It is also common to use either an entrance loop 16 or an exit loop 14. These additional wire loops are connected in series with the center loop 12. As a vehicle passes over loop 12, the metal and mass of the vehicle changes the inductance of the loop, altering the current output.

Figure 3:
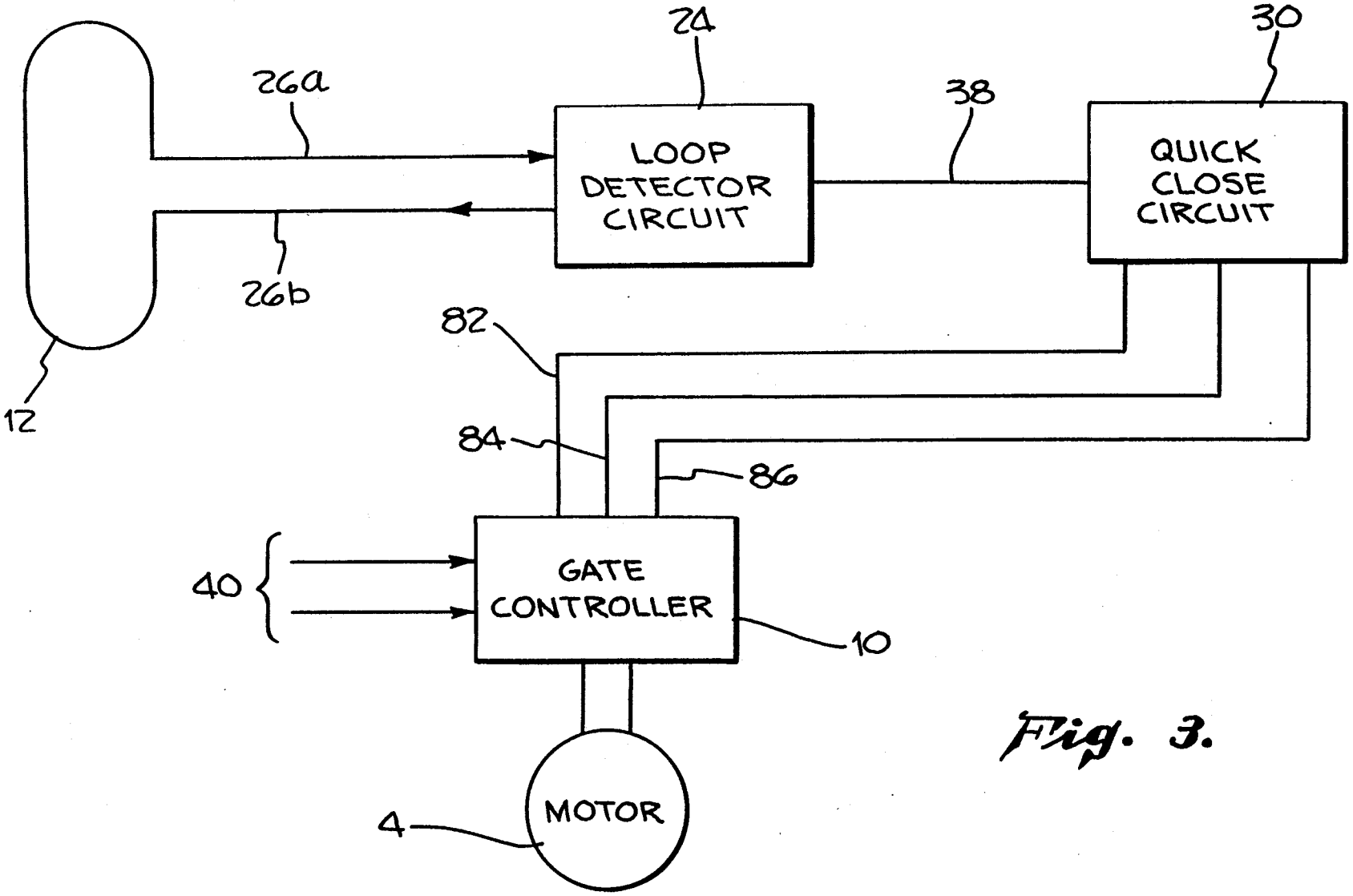
FIG. 3 is a block diagram showing the quick close circuit in conjunction with exemplary gate controller and loop detector circuits.

Referring now to FIG. 3, there is shown a block diagram of an exemplary electric gate system. The wire loop 12 operates in conjunction with loop detector circuit 24 to sense the presence of vehicles in loop 12, and issues commands to gate controller 10 to operate motor 4, which ultimately moves gate 2. Gate controller 10 can receive gate opening commands from a variety of inputs 40, such as an RF transmitter or key switch. Inputs 26 a and b from wire loop 12 enter exemplary loop detector circuit 24. A change in current from inputs 26 a and b caused by presence of a vehicle in loop 12 is sensed by the loop detector circuit 24, which could then signal other circuits, such as the gate controller circuit, to keep the gate open. Such gate controller and loop detector circuits are well known in the industry.

In addition, the exemplary gate controller 10 can receive three external gate control signals: gate opening (safety) 82, gate stop 84, and gate close 86. The gate opening signal 82 indicates to controller 10 that a vehicle is within the proximity of gate 2, and that gate 2 should continue to open. This signal would ordinarily originate with loop detector circuit 24. The gate stop signal 84 terminates the gate opening sequence. The gate close signal 86 reverses the direction of motor 4, to close gate 2.

In accordance with the present invention, the improvement of a quick close circuit for an electric powered gate having a wire loop control system, comprises a means for detecting the passage of a vehicle through the passageway, and a means for commanding the gate control circuit to stop opening the gate and to commence closing the gate after the passage of the vehicle. FIG. 3 shows quick close circuit 30 connected in series between loop detector circuit 24 and gate controller 30. In operation, the quick close circuit 30 will respond to detection signal 38 from loop detector circuit 24 by sending safety signal 82 to gate controller 10. Once the vehicle has passed wire loop 12, quick close circuit 30 will send gate stop signal 84 to gate controller 10. Shortly thereafter, quick close circuit 30 will send gate close signal 86 to gate controller 10.

Figure 4:
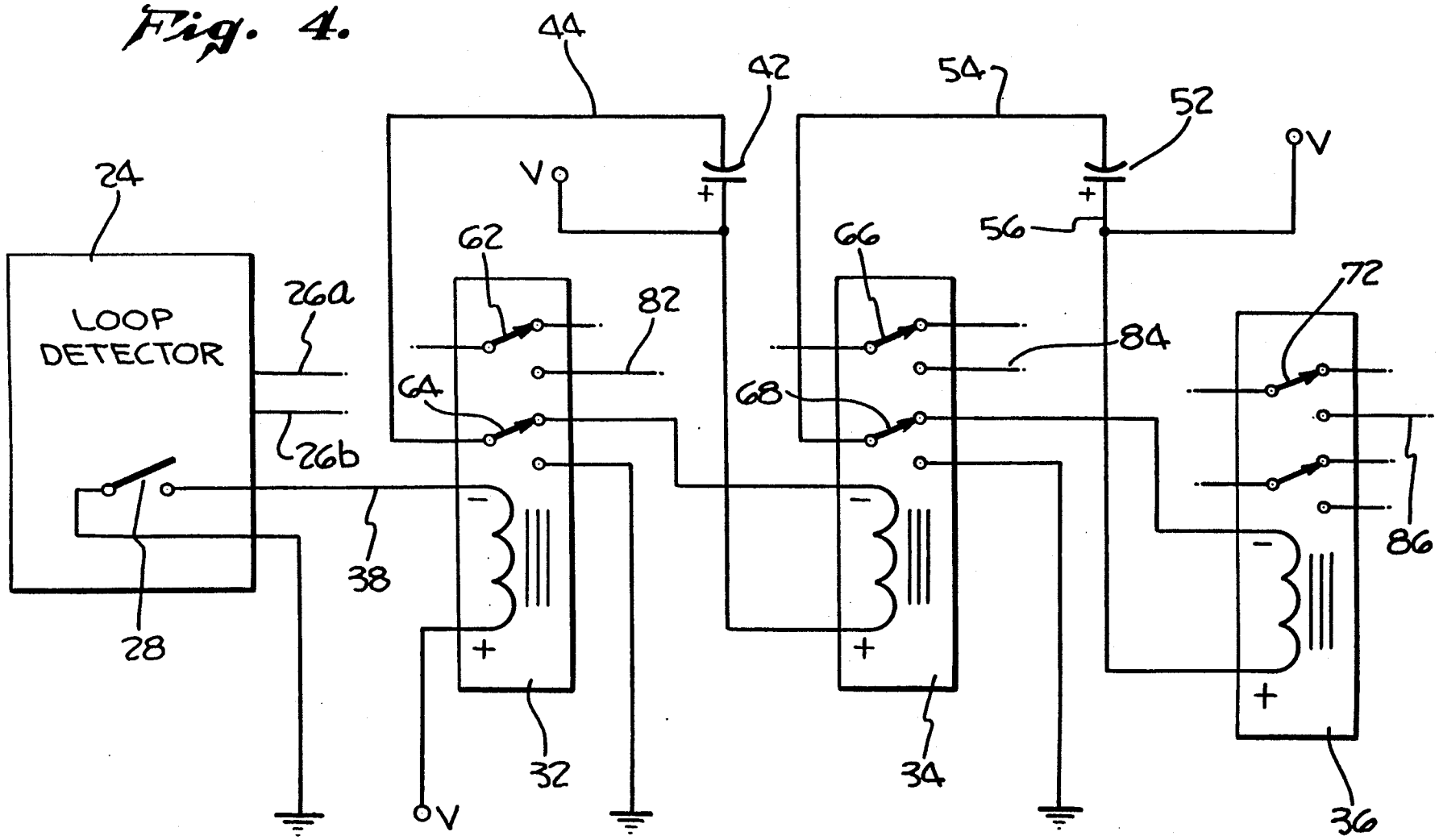
FIG. 4 is an electrical circuit schematically showing the quick close circuit of the present invention.

As shown in the schematic diagram of FIG. 4, the detecting means further comprises first relay 32 and first capacitor 42. First relay 32 has a first and second switch, 62 and 64, respectively. First capacitor 42 has a first and second lead, 44 and 46, respectively. First lead 44 of first capacitor 42 is normally connected to second switch 64 of first relay 32. Second lead 46 of first capacitor 42 is normally connected to voltage source V.

For simplification, loop detector circuit 24 of FIG. 4 is represented by switch 28. Switch 28 closes upon presence of a vehicle in loop 12, applying a voltage V across first relay 32, further causing it to actuate. Once actuated, first switch 62 of first relay 32 forms safety signal 82 to gate controller circuit 10 to open gate 2. Simultaneously, second switch 64 of first relay 32 connects first lead 44 of first capacitor 42 to ground, charging the capacitor.

The commanding means further comprises second relay 34, third relay 36 and second capacitor 52. Second relay 34 has first and second switch, 66 and 68, respectively. Third relay 36 has first switch 72. Second capacitor 52 has first and second lead, 54 and 56, respectively. First lead 54 is normally connected to second switch 68. Second lead 56 is normally connected to voltage source V. The charge on first capacitor 42 actuates second relay 34 upon de-actuation of first relay 32. First switch 66 of second relay 34 forms gate stop signal 84 to gate controller circuit 10 to stop movement of gate 2 upon actuation of second relay 34. Second switch 68 of second relay 34 connects first lead 54 of second capacitor 52 to ground, charging the capacitor.

Similarly, the charge on second capacitor 52 actuates third relay 36 upon de-actuation of second relay 34. First switch 72 of third relay 36 forms gate close signal 86 to gate controller circuit 10 to close gate 2 upon actuation of third relay 36.

Having thus described a preferred exemplary embodiment of DC back up system for an electric gate, it should now be apparent to those skilled in the art that the aforestated objects and advantages for the within system have been achieved. It should also be appreciated by those skilled in the art that various modifications, adaptations and alternative embodiments thereof may be made within the scope and spirit of the present invention which is defined by the following claims.

What is claimed is:

1. In an electric powered gate having a wire loop control system comprising a gate controller circuit, a wire loop in the passageway of said gate, and a loop detector circuit to detect the presence of vehicles in said loop, the improvement being a quick close circuit comprising:

means for opening said gate upon detection of a vehicle in said passageway by said loop detector circuit, said opening means comprising:

a first relay and a first capacitor, said first relay having a first and second switch, said first capacitor having a first and second lead, said first lead of said first capacitor normally connected to said second switch of said first relay, said second lead of said first capacitor normally connected to a voltage source; and said loop detector circuit generating a sensing command upon presence of said vehicle in said loop, said sensing command actuating said first relay, said first switch of said first relay providing a safety signal to said gate controller circuit to open said gate upon actuation of said first relay, said second switch of first relay connecting said first lead of said first capacitor to ground charging said first capacitor; and means for stopping further opening of said gate and for closing said gate after said vehicle has passed said loop.

2. The quick close circuit of claim 1 wherein said stopping and closing means further comprises:

a second relay and a second capacitor, said second relay having a first and second switch, said second capacitor having a first and second lead, said first lead of said second capacitor normally connected to said second switch, said second lead of said second capacitor normally connected to said voltage source, said first capacitor actuating said second relay upon de-actuation of said first relay, said first switch of said second relay providing a stop signal to said gate controller circuit to stop movement of said gate upon actuation of said second relay, said second switch of said second relay connecting said first lead of said second capacitor to ground charging said second capacitor; and a third relay having a first switch, said second capacitor actuating said third relay upon de-actuation of said second relay, said first switch of said third relay providing a closing signal to said gate controller circuit to close said gate upon actuation of said third relay.

3. A quick close circuit for an electric gate, comprising in combination:

a gate control means for controlling operation of said gate, a wire loop in the passageway of said gate, and a loop detector means for sensing the presence of vehicles in said loop;

an opening means for opening said gate upon detection of a vehicle in said passageway by said loop detector means; and a closing means for automatically commanding said gate control means to stop opening said gate and to automatically commence closing said gate shortly after said vehicle has passed said loop, wherein said opening means further comprises:

a first relay and a first capacitor, said first relay having a first and second switch, said first capacitor having a first and second lead, said first lead of said first capacitor normally connected to said second switch of said first relay, said second lead of said first capacitor normally connected to a voltage source; and said loop detector means providing a sensing command upon presence of said vehicle in said loop, said sensing command actuating said first relay, said first switch of said first relay providing a safety signal to said gate control means to open said gate upon actuation of said first relay, said second switch of said first relay connecting said first lead of said first capacitor to ground charging said first capacitor.

4. The quick close circuit of claim 3, wherein said closing means further comprises:

a second relay and a second capacitor, said second relay having a first and second switch, said second capacitor having a first and second lead, said first lead of said second capacitor normally connected to said second switch, said second lead of said second capacitor normally connected to said voltage source, said first capacitor actuating said second relay upon de-actuation of said first relay, said first witch of said second relay providing a stop signal to said gate control means to stop movement of said gate upon actuation of said second relay, said second switch of second relay connecting said first lead of said second capacitor to ground charging said second capacitor; and a third relay having a first switch, said second capacitor actuating said third relay upon de-actuation of said second relay, said first switch of said third relay providing a closing signal to said gate control means to close said gate upon actuation of said third relay.

5. In an electric powered gate having a wire loop control system comprising a gate controller circuit, a wire loop in the passageway of said gate, and a loop detector circuit to sense the presence of vehicles in said loop, the improvement being a quick close circuit comprising:

means for opening said gate upon detection of a vehicle by said loop detector circuit, said opening means comprising a first relay and a first capacitor, said first relay having a first and second switch, said first capacitor having a first and second lead, said first lead of said first capacitor normally connected to said second switch of said first relay, said second lead of said first capacitor normally connected to a voltage source; and means for commanding said gate control circuit to stop opening said gate and to commence closing said gate after said vehicle has passed said loop, said commanding means comprising a second relay, a third relay and a second capacitor, said second relay having a first and second switch, said second capacitor having a first and second lead, said first lead of said second capacitor normally connected to said second switch, said second lead of said second capacitor normally connected to said voltage source, said third relay having a first switch, said second capacitor actuating said third relay upon de-actuation of said second relay, said first switch of said third relay providing a closing signal to said gate control circuit to close said gate upon actuation of said third relay.

6. The quick close circuit of claim 5, wherein:

said loop detector circuit generates a sensing command upon presence of said vehicle in said loop, said sensing command actuating said first relay, said first switch of said first relay providing a safety signal to said gate control circuit to open said gate upon actuation of said first relay, said second switch of said first relay connecting said first lead of said first capacitor to ground charging said first capacitor.

7. The quick close circuit of claim 5, wherein said first capacitor actuates said second relay upon de-actuation of said first relay, said first switch of said second relay providing a stop signal to said gate control circuit to stop movement of said gate upon actuation of said second relay, said second switch of said second relay connecting said first lead of said second capacitor to ground charging said second capacitor.

8. In an electric powered gate having a wire loop control system comprising a gate controller circuit, a wire loop in the passageway of said gate, and a loop detector circuit to detect the presence of vehicles in said loop, the improvement being a quick close circuit comprising:

means for opening said gate upon detection of presence of a vehicle in said passageway by said loop detector circuit, said opening means comprising a first relay and a first capacitor, said loop detector circuit generating a sensing command upon presence of said vehicle in said loop, said sensing command actuating said first relay to provide a safety signal to said gate controller circuit to open said gate; and means for stopping further opening of said gate and for closing said gate shortly after said vehicle has passed said loop, wherein said stopping and closing means further comprises:

a second relay and a second capacitor, said first capacitor actuating said second relay upon de-actuation of said first relay, said second relay providing a stop signal to said gate controller circuit to stop movement of said gate upon actuation of said second relay; and a third relay, said second capacitor actuating said third relay upon de-actuation of said second relay, said third relay providing a closing signal to said gate controller circuit to close said gate upon actuation of said third relay.

* * * * *